US007185721B2

(12) United States Patent
Carlström et al.

(10) Patent No.: US 7,185,721 B2
(45) Date of Patent: Mar. 6, 2007

(54) MALE PORTION, DRILL BIT AND THREADED JOINT FOR PERCUSSIVE ROCK DRILLING

(75) Inventors: Bo Carlström, Sandviken (SE); Anders Brungs, Gävle (SE); Christer Lundberg, Gävle (SE); Per-Olof Liljebrand, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 140 days.

(21) Appl. No.: 10/603,653

(22) Filed: Jun. 26, 2003

(65) Prior Publication Data

US 2004/0050592 A1 Mar. 18, 2004

(30) Foreign Application Priority Data

Jun. 27, 2002 (SE) ..... 0201989

(51) Int. Cl.
*E21B 17/042* (2006.01)
*E21B 10/36* (2006.01)

(52) U.S. Cl. ..... 175/414; 166/380; 166/242.6; 175/395; 403/343; 403/348

(58) Field of Classification Search ..... 175/293, 175/320, 323, 394, 395, 414; 166/380, 242.1, 166/242.6; 285/340, 334; 403/343, 40, 403/62, 296, 348, 370, 374.3, 299
See application file for complete search history.

(56) References Cited

U.S. PATENT DOCUMENTS 2,052,019 A * 8/1936 Baker ..... 403/343
3,388,935 A * 6/1968 Hjalsten et al. ..... 403/343
3,537,738 A * 11/1970 Fischer et al. ..... 403/343
3,645,570 A * 2/1972 Johansson et al. ..... 403/307
3,822,952 A * 7/1974 Johansson et al. ..... 403/343
4,040,756 A * 8/1977 Donegan ..... 403/307
4,295,751 A * 10/1981 Holmberg ..... 403/306
4,332,502 A * 6/1982 Wormald et al. ..... 403/343
4,441,565 A * 4/1984 Liljekvist ..... 175/325.3
4,687,368 A * 8/1987 Eklof et al. ..... 403/343
4,760,887 A * 8/1988 Jansson et al. ..... 173/132
4,968,068 A * 11/1990 Larsson ..... 285/390
5,785,360 A * 7/1998 Nordfeldt et al. ..... 285/328
5,984,030 A * 11/1999 Larsson et al. ..... 175/414
6,196,598 B1 * 3/2001 Yao ..... 285/333
6,293,360 B1 * 9/2001 Liljebrand et al. ..... 175/320
6,334,493 B2 * 1/2002 Linden ..... 173/1
6,394,190 B2 * 5/2002 Linden ..... 173/1

(Continued)

OTHER PUBLICATIONS

PCT International Search Report dated Aug. 29, 2003.

*Primary Examiner*—Jennifer H. Gay
(74) *Attorney, Agent, or Firm*—Drinker Biddle & Reath LLP

(57) ABSTRACT

A male portion for percussive rock drilling includes sections of reduced cross-sectional area. At least one thread for percussive rock drilling is provided at an end of the male portion. The end of the male portion comprises an abutment surface for the transfer of impact waves. The length of the portion is defined as the length of an imaginary cylinder from a plane of the impact surface to a point where the plane ceases to contact a crest of the thread, wherein the length divided by the external diameter of the cylinder lies within a range of 1–2.

13 Claims, 5 Drawing Sheets

U.S. PATENT DOCUMENTS 6,767,156 B1 * 7/2004 Larsson ..... 403/343
6,810,956 B1 * 11/2004 Sandstrom ..... 166/242.6
2002/0050362 A1 * 5/2002 Larsson et al. ..... 166/380
2002/0074797 A1 * 6/2002 Liljebrand et al. ..... 285/333

* cited by examiner

MALE PORTION, DRILL BIT AND THREADED JOINT FOR PERCUSSIVE ROCK DRILLING

This application claims priority under 35 U.S.C. §§ 119 and/or 365 to patent application Ser. No. 0201989-1 filed in Sweden on Jun. 27, 2002, the entire content of which is hereby incorporated by reference.

BACKGROUND OF THE INVENTION

The present invention relates to a male portion, a drill bit and a threaded joint for percussive rock drilling.

1. Prior Art

In percussive top hammer drilling in rock, a drill string is intended to be fastened in a shank adapter in a drilling machine via one end surface of a rod element or a tube element. The other end of the rod or tube is threaded either to another rod or to another tube or to a drill bit for percussive drilling. The rod or the tube can also be fastened to the shank adapter or another detail by means of threaded sleeves. A flush channel runs through the entire drill string in order to lead flush medium to the drill bit to coil away drill cuttings.

At drilling the drill string, i.e., crowns, rods, tube, sleeves and shank adapters, is subjected to mechanical and corrosive attack. This applies especially when drilling below earth where water is used as flush medium and where the environment is humid. Attacks are especially serious at the most stressed parts, that is, in thread bottoms and other reductions, that have small cross-sectional area. The drilling tool is often subjected to bending moments in connection with the drill bit reaching a skew wall in a cavity in the rock. In combination with pulsating strain, caused by impact waves and bending stresses, fatigue or breakage arises.

2. Objects of the Invention

An object of the present invention is to considerably improve the resistance against fatigue in a drill element for percussive rock drilling.

Another object of the present invention is to considerably improve the resistance against fatigue in sections of reduced cross-sectional areas in a drill element for percussive rock drilling.

Still another object of the present invention is to considerably improve the resistance against fatigue in thread bottoms in a threaded portion in a drill element for percussive rock drilling.

SUMMARY OF THE INVENTION

The invention relates to a male portion for percussive rock drilling, the male portion having an end portion on which an external thread for percussive rock drilling is provided. An end surface of the male portion comprises an abutment surface for the transfer of impact waves. The male portion has a first-cross-sectional area along a region thereof where the thread has a full profile, wherein a length of the male portion is defined as a length from a plane of the impact surface to a point where an imaginary coaxial circular cylinder ceases to touch a crest of the thread. A quotient of said length divided by the diameter of the cylinder, lies within the range of 1–2. The male portion has a second cross-sectional area situated farther from said impact surface than said length L. The second cross-sectional area is greater than said first cross-sectional area.

The invention also pertains to a drill bit for percussive rock drilling having an end provided with a central recess having an internal thread for percussive rock drilling provided along a portion of the recess. The recess comprises an abutment surface at an inner end thereof, wherein a length is defined from the impact surface to a point where an imaginary coaxial circular cylinder ceases to contact a crest of the thread. A quotient of the length divided by the diameter of the imaginary cylinder lies within the range of 1–2.

The invention also relates to a threaded joint between a male portion and drill bit for percussive rock drilling. The male portion comprises at least one male thread for percussive rock drilling provided at a first portion at an end of the male portion, an end surface of the male portion comprises an abutment surface for the transfer of impact waves. The male portion has a first cross-sectional area in a region where the thread has full profile, said drill bit provided with a central recess comprising an internal female thread for percussive rock drilling provided along a portion of the recess. The recess comprises an abutment surface at an inner end thereof, wherein a first length is defined from the impact surface to a point where a first imaginary coaxial circular cylinder ceases to contact a crest of the male thread. A quotient of said first length divided by the diameter of the first cylinder lies with a first range of 1–2. A second length is defined from the impact surface to a point where a second coaxial circular cylinder ceases to touch a crest of the female thread. A quotient of the second length divided by the diameter of the second cylinder lies within a second range of 1–2.

BRIEF DESCRIPTION OF THE DRAWINGS

The objects and advantages of the invention will become apparent from the following detailed description of a preferred embodiment thereof in connection with the accompanying drawings and in which like numerals designate like elements.

DESCRIPTION OF A PREFERRED EMBODIMENT OF THE INVENTION

Figure 1:
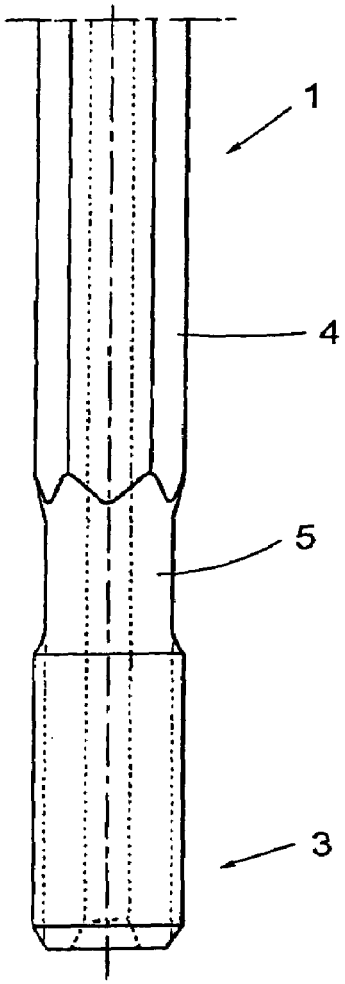
Fig. 1 (Prior Art)
FIG. 1 shows a male portion of a conventional rod in a side view.
Figure 2:
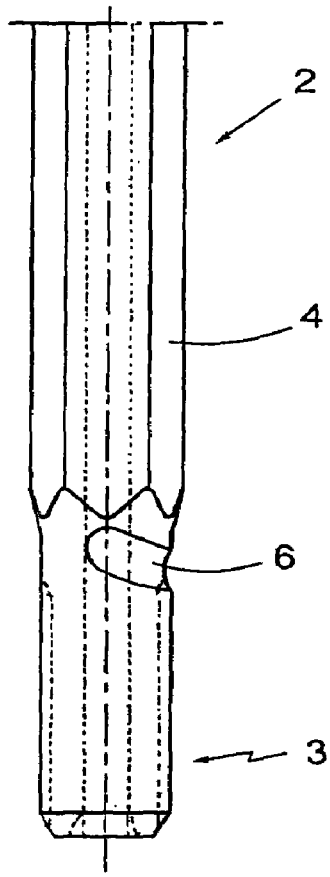
Fig. 2 (Prior Art)
FIG. 2 shows another male portion of a conventional rod in a side view.
Figure 3A:
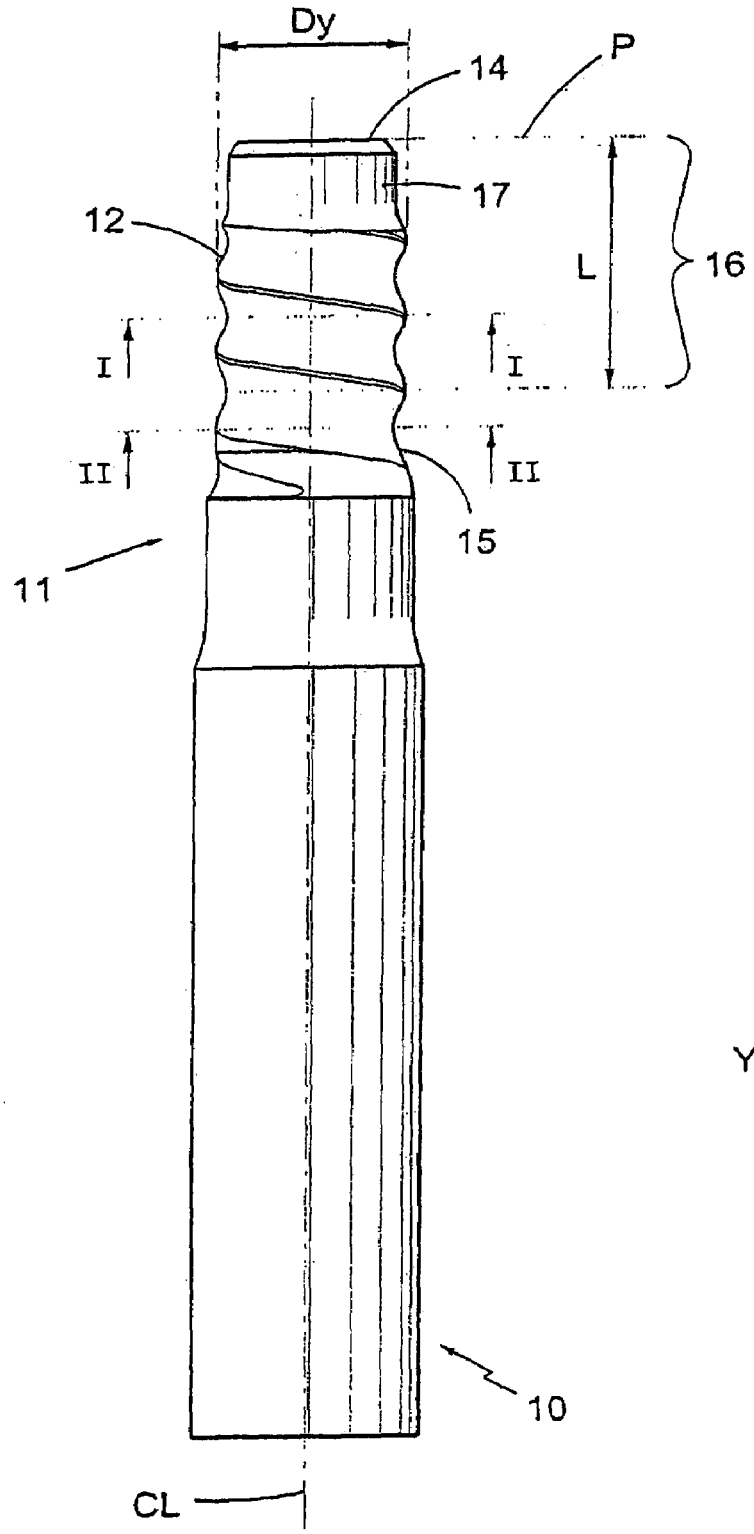
FIG. 3A shows a male portion according to the present invention of a rod in a side view.
Figure 3B:
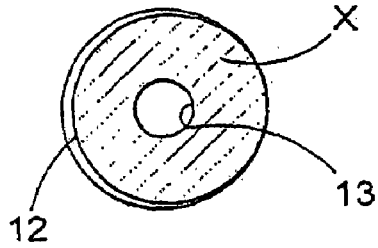
FIG. 3B shows a cross-section according to the line I—I in FIG. 3A.
Figure 3C:
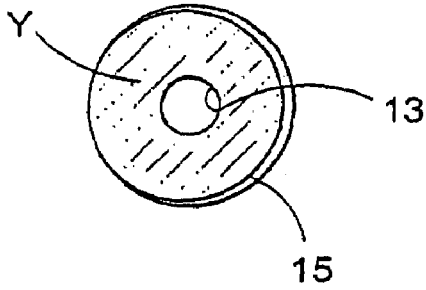
FIG. 3C shows a cross-section according to line II—II in FIG. 3A.
Figure 3D:
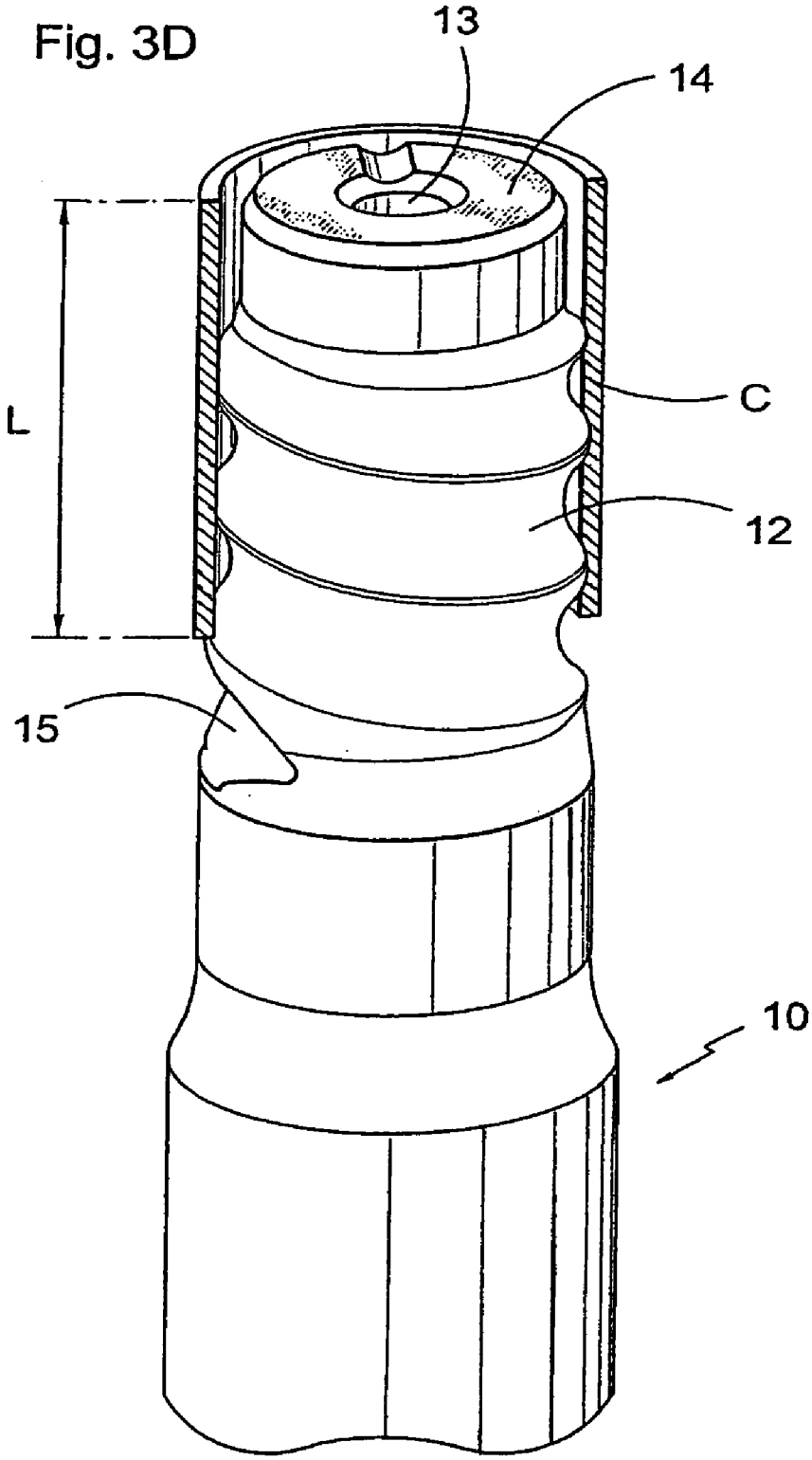
FIG. 3D shows the male portion in a perspective.

Each of the prior art rods 1, 2 for percussive drilling shown in FIGS. 1 and 2 is provided with an externally threaded male portion 3 at its one end (the thread represented schematically), and an identical male portion, or a female portion in the shape of an internally threaded, sleeve-shaped portion at its other end, not shown. The male portion 3 is connected in this case to a round rod 4, preferably by friction welding. The weakest cross-section of the male portion is where the smallest cross-sectional area is found, i.e., see the thread clearance 5 and the last thread turn 6.

In a simulated bending test with the aid of the finite element method (FEM) we have found that it is possible to considerably lower the load at the weakest cross-section of the male portion and thereby obtain longer life spans for the male portions.

The end of the drill rod 10 for percussive drilling shown in FIGS. 3A–3D is formed with a spigot or male portion 11 according to the present invention provided with a male thread or external thread 12. The drill rod further has a through-going flush channel 13, through which a flush medium, generally air or water, is led. The front end surface of the male portion 11 forms a ring-shaped abutment surface 14, which at connection to a drill bit is intended to abut against a corresponding annular abutment surface at a bottom of a central recess in the drill bit. Along a region of the full profile of the thread disposed adjacent to the front end of the thread, the male portion 11 has a smallest first cross-sectional area X, see the hatched area in FIG. 3B. The male portion 11 comprises a last thread turn 15 or a thread exit with an increased second cross-sectional area relative to the field of the full profile of the thread, see the hatched area Y in FIG. 3G. The smallest cross-sectional area X of the male portion is provided in the region where the thread has full profile, and the second (larger) cross-sectional area Y is measured within the interval of 1–5 mm from the end of the region having the first cross-sectional area. The thread 12 is provided at a first portion 16 at the end of the male portion. A length or distance L of the portion 16 is defined as a length which begins at a plane P of the impact surface 14 of an imaginary, coaxial straight circular cylinder C that touches the crest of the thread (which defines a major diameter Dy of the thread), see FIG. 3D. As the imaginary cylinder C progresses away from the abutment surface 14, it will eventually reach a point where it no longer touches the crest of the thread, as the cross-sectional area starts to increase, i.e., the thread is no longer at full profile. That point defines the other end of the length L. The diameter Dy (which corresponds to the diameter of the cylinder C) is preferably smaller than 37 mm. The plane P is perpendicular to the centerline CL. The quotient of the length L divided by the diameter Dy of the cylinder lies within the interval of 1–2. The interval is preferably 1.2–1.9 and most preferably 1.3–1.6. As an example, it can be mentioned that male portions with a length L=57 mm and cylinder diameter Dy=32.85 mm provide a ratio L/Dy of about 1.7 and male portions with L=44.3 mm and Dy=32.85 provide a ratio of about 1.3. The abutment surface 14 connects via a chamfer to a spigot 17 that is cylindrical or conical. The spigot 17 lacks thread and is in certain cases intended to steer on a recess in the drill bit when the connection has been mounted. The spigot 17 connects to the thread 12.

Figure 4:
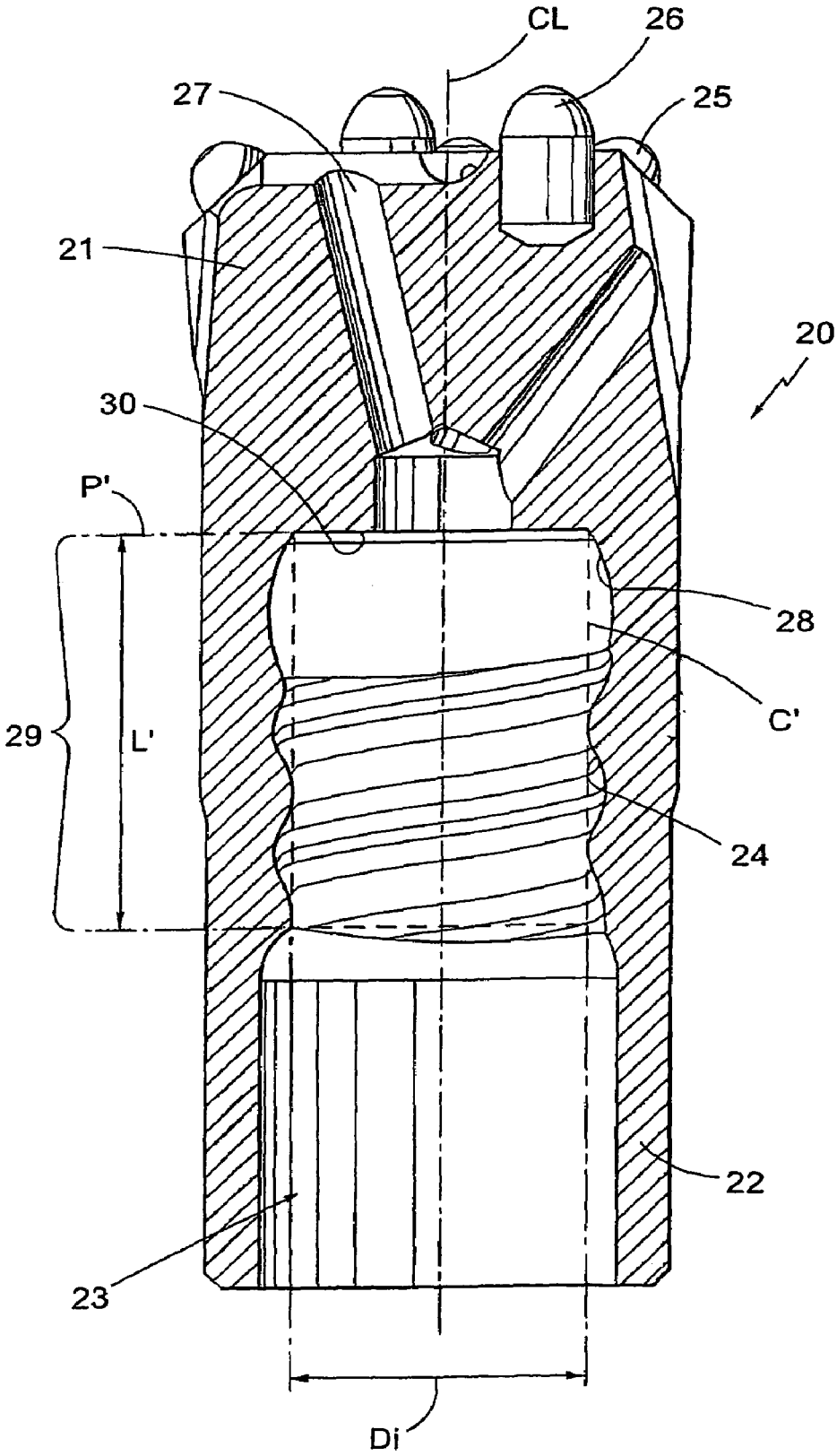
FIG. 4 shows an axial cross-section of a drill bit according to the present invention.

The drill bit 20 for percussive drilling shown in FIG. 4 comprises a drill head 21 and a shank or a skirt 22. The drill head 21 and the skirt 22 are formed in one piece. A common longitudinal center line CL for the drill bit 20 and the male portion 10 is drawn in the figures. The drill bit 20 is provided with a recess 23 provided with an internal female thread 24, which will receive the external male thread 12 of the male portion 10. The drill head 21 of the drill bit according to the present invention is in usual manner provided with rock cutting means, in the shown embodiment having the shape of cemented carbide inserts, of which a number of circularly positioned peripheral inserts 25 and two front buttons 26 are shown. A number of flushing channels 27 extends axially between the recess 23 of the drill bit and the front of the drill head 21. An abutment surface 30, a so-called bottom abutment, is provided at the bottom of said recess for contacting the abutment surface 14 of the male portion 10.

The thread 24 comprises a thread clearance 28 of reduced cross-sectional area. The thread 24 is provided at a second portion 29 in the recess 23. The length or distance L' of the portion 29 is the length from a plane P' of the impact surface 30, that an imaginary, straight circular cylinder C' touches the crest of the thread. The diameter Di of the cylinder C', which corresponds to the minor diameter of the thread, is smaller than 37 mm, preferably less than 36 mm. The plane P' is perpendicular to the centerline CL. The quotient of the length L' divided by the diameter Di of the cylinder lies within the interval 1–2. The interval is preferably 1.2–1.9 and most preferably 1.3–1.6. The abutment surface 30 connects via a shoulder to the thread clearance 28. The thread clearance connects to the thread 24. As an example can be mentioned that drill bits with the length L'=39.7 mm and Di=29.5 mm give the approximate quota 1.4 and drill bits with the length L'=52.5 mm and Di=29.5 mm give the approximate quota 1.8.

The lengths L, L' are calculated from the respective planes P, P' as long as the thread has a full profile. Stated alternatively, a straight circular cylinder should be able to enter over the male portion 10 or to be moved into the recess 23 with a slide fit a distance or a length L, L' from the plane P, P' until the cylinder either clears from the thread or abuts against a thickened thread end.

Figure 5:
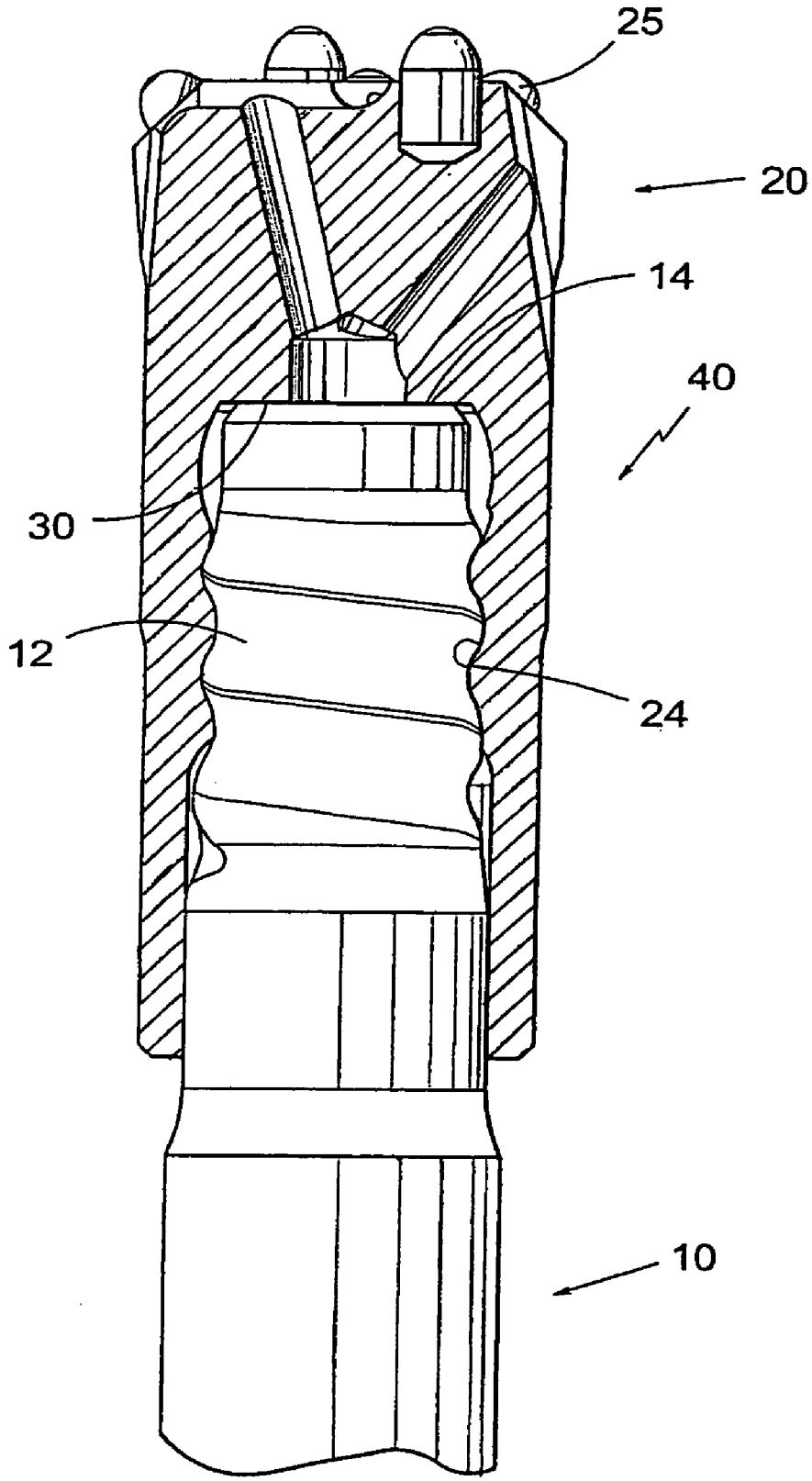
FIG. 5 shows a threaded joint according to the present invention partially in cross-section.

In FIG. 5 a threaded joint 40 according to the present invention is shown comprising the male portion 10 and the drill bit 20. The male portion 10 has been screwed into the drill bit 20 until the impact surfaces 14 and 30 impacted against each other. Since the part of reduced cross-sectional area on the male portion 10 is provided at a relatively short distance from the free end of the joint 40 the bending stress will be lower there than at conventional joints where the lever is considerably longer. The male portion and the drill bit comprise respective cylindrical surfaces provided axially beyond and radially outside of the threads for a slide fit against each other during mounting.

The basis for the invention is that a shorter thread gives lower bending stress. The tension in the last thread turn or the thread clearance is lowered by at least 30% as compared with known joints. Generally just a few thread turns, for example two thread turns on each part, are in engagement with the other part as can be concluded from FIGS. 3A, 4 and 5. With a conventional threaded joint, normal tool life is about 850 m of drilling depth while the new male portion reached about 2050 m before the joint was considered worn-out.

Although the present invention has been described in connection with a preferred embodiment thereof, it will be appreciated by those skilled in the art that additions, modifications, substitutions and deletions not specifically described may be made without departing from the spirit and scope of the invention as defined by the appended claims.

What is claimed is:

1. A drill bit for percussive rock drilling having an end portion provided with a central recess having an internal thread for percussive rock drilling provided along a portion of the recess, said recess comprising an abutment surface at an inner end thereof, wherein a length L' is defined from the abutment surface to a point where an imaginary coaxial circular cylinder ceases to contact a crest of the thread, wherein a quotient of the length L' divided by the diameter Di of the imaginary cylinder lies within the range of 1–2, wherein the diameter Di of the imaginary cylinder is less than 36 mm.

2. The drill bit according to claim 1, wherein the range is 1.2–1.9.

3. The drill bit according to claim 1, wherein the range is 1.3–1.6.

4. The drill bit according to claim 1, rigidly connected to an end of an rod or a tube of steel to form a drill rod having a through-going axial flush channel.

5. A male element for percussive rock drilling, the male element having a front end portion on which an external thread for percussive rock drilling is provided; a front end surface of the male element comprising an abutment surface for the transfer of impact waves; said thread including a full profile region of constant first cross-sectional area disposed adjacent a front end of said thread, wherein a length L of the male element is defined as a length from a plane of an impact surface of an imaginary cylinder that touches a crest of the thread to a point where the thread ceases to be at full profile, wherein a quotient of said length L divided by the diameter of the imaginary cylinder, lies within the range of 1–2; said thread including a last turn whose cross-sectional area gradually increases to be greater than said first cross-sectional area of said full profile region to define a thread exit.

6. The male element according to claim 5, wherein the range is 1.2–1.9.

7. The male element according to claim 6, wherein the diameter of the cylinder is less than 37 mm.

8. The male element according to claim 7, wherein the range is 1.3–1.6.

9. The male element according to claim 5 fixedly connected to an end of a rod or a tube of steel to form a drill rod having a through-going axial flush channel.

10. A threaded joint between a male portion and a drill bit for percussive rock drilling, said male portion comprising at least one male thread for percussive rock drilling, an end surface of the male portion comprising a first abutment surface for the transfer of impact waves, said drill bit provided with a central recess comprising an internal female thread for percussive rock drilling provided along a portion of the recess, said recess comprising a second abutment surface at an inner end thereof, wherein a first length L' is defined from the second abutment surface to a point where a first coaxial circular imaginary cylinder C' ceases to contact a crest of the thread, wherein a quotient of said first length L divided by a diameter of the first cylinder lies within a first range of 1–2; said male thread including a full profile region of constant first cross sectional area disposed adjacent a front end of said male thread, wherein a second imaginary cylinder touches the crest of said full profile region; said male thread including a last turn whose cross-sectional area gradually increases to be greater than said first cross sectional area of said full profile region to define a thread exit; wherein a length L of the male portion is defined as a length from a plane of the first abutment surface to a point where the thread ceases to be at full profile, wherein a quotient of said length L divided by a diameter of the second imaginary cylinder, lies within a second range of 1–2.

11. The threaded joint according to claim 10, wherein each of the first and second ranges is 1.2–1.9.

12. The threaded joint according to claim 11, wherein the diameter of each of the first and second cylinders is less than 37 mm.

13. The threaded joint according to claim 12, wherein each of the first and second ranges is 1.3–1.6.

* * * * *

UNITED STATES PATENT AND TRADEMARK OFFICE

CERTIFICATE OF CORRECTION

PATENT NO. : 7,185,721 B2
APPLICATION NO. : 10/603653
DATED : March 6, 2007
INVENTOR(S) : Carlström et al.

It is certified that error appears in the above-identified patent and that said Letters Patent is hereby corrected as shown below:

In Claim 10, at column 6, lines 9-10, please replace "first length L" with --first length L'--.

Signed and Sealed this

Eleventh Day of December, 2007

JON W. DUDAS
*Director of the United States Patent and Trademark Office*